US005975522A

United States Patent [19]

Fujimaki

[11] Patent Number: 5,975,522

[45] Date of Patent: Nov. 2, 1999

[54] DISCHARGED-SHEET RECEIVING TABLE FOR AN IMAGE FORMING APPARATUS

[75] Inventor: Fumio Fujimaki, Ibaraki, Japan

[73] Assignee: Riso Kagaku Corporation, Tokyo, Japan

[21] Appl. No.: 08/855,892

[22] Filed: May 12, 1997

[30] Foreign Application Priority Data

May 13, 1996 [JP] Japan ..... 8-117723

[51] Int. Cl.[6] ..... B65H 31/04; B65H 31/00

[52] U.S. Cl. ..... 271/213; 271/207; 271/214

[58] Field of Search ..... 271/213, 207, 271/214, 162, 163

[56] References Cited

U.S. PATENT DOCUMENTS

| | | | |
|---|---|---|---|
| 4,359,218 | 11/1982 | Karis | 271/213 |
| 5,005,822 | 4/1991 | Max et al. | 271/213 |
| 5,054,765 | 10/1991 | Henn et al. | 271/213 |
| 5,169,375 | 12/1992 | Wachtler | 271/213 |
| 5,234,212 | 8/1993 | Dutra, Jr. | 271/213 |
| 5,284,336 | 2/1994 | Ricciardi | 271/213 |

FOREIGN PATENT DOCUMENTS

| | | | |
|---|---|---|---|
| 0167170 | 6/1989 | Japan | 271/213 |
| 404039257A | 2/1992 | Japan | 271/213 |

OTHER PUBLICATIONS

Patent Abstracts of Japan, vol. 12, No. 142 (M–692), Apr. 30, 1988 & JP 62 264160 A (Nippon Kogaku KK), Nov. 17, 1987, *Abstracts* .

Patent Abstracts of Japan, vol. 16, No. 214 (M–1251), May 20, 1992 & JP 04 039254 A (Ricoh Co Ltd), Feb. 10, 1992, *abstracts*.

Patent Abstracts of Japan, vol. 17, No. 286 (M–1422), Jun. 2, 1993 & JP 05 016514 A (Rocoh Co Ltd.), Jan. 26, 1993, *abstracts*.

Patent Abstracts of Japan, vol. 13, No. 559 (M–905), Dec. 12, 1989 & JP 01 231752 A (Sanyo Electric Co Ltd.), Sep. 18, 1989, *abstracts*.

*Primary Examiner*—William E. Terrell
*Assistant Examiner*—Wonki K. Park
*Attorney, Agent, or Firm*—Sughrue, Mion, Zinn, Macpeak & Seas, PLLC

[57] ABSTRACT

A discharged-sheet table device mounted to an image forming apparatus near the sheet discharging port for receiving a recorded sheet discharged from the sheet discharging port of the image forming apparatus. The discharged-sheet table device includes a first base mounted near the sheet discharging port of the image forming apparatus; a second base movably supported on the first base; a discharged-sheet table movably mounted on the second base to receive the recorded sheet which is discharged from the image forming apparatus; a table moving mechanism for movably holding the discharged-sheet table between a first position where the recorded sheet discharged from the sheet discharging port is received and a second position located forwardly of the first position in the direction in which the recorded sheet is discharged from the sheet discharging port; and a first base moving mechanism disposed between the first base and the second base, for movably holding the second base between the second position and a third position offset in a direction horizontally from the direction in which the recorded sheet is discharged from the sheet discharging port. To remove a stack of papers from the discharged-sheet table, an operator moves the discharged-sheet table from the first position to the second position forward of the first position and away from the discharging port, and then to moves the discharged-sheet table from the second position the third position which is laterally offset from the first and second positions.

9 Claims, 10 Drawing Sheets

DISCHARGED-SHEET RECEIVING TABLE FOR AN IMAGE FORMING APPARATUS

BACKGROUND OF THE INVENTION

The present invention relates to a discharged-sheet table device which is attached to an image forming apparatus, such as a copying machine, a laser beam printer, or a printing machine, so as to receive recorded sheet being discharged from such an image forming apparatus.

As shown in FIG. 10, a sheet discharging port 2 for discharging a recording sheet on which an image has been formed is conventionally provided on one side surface of an image forming apparatus 1, such as a copying machine, a laser beam printer, or a printing machine. A discharged-sheet table device 3 for receiving the recording sheet which is discharged is provided for this sheet discharging port 2. The discharged-sheet table device 3 is provided in such a manner as to project from the sheet discharging port 2, and fences 3*a*, 3*b*, and the like are provided uprightly on an upper surface thereof. The discharged-sheet table device 3 is generally mounted detachably on the image forming apparatus 1. Alternatively, some discharged-sheet table devices are structured such that, when the image forming apparatus 1 is not used, the discharged-sheet table device 3 is slid horizontally toward the sheet discharging port 2 so as to be accommodated in the image forming apparatus 1. Further, some other discharged-sheet table devices are structured such that one end portion of the discharged-sheet table device 3 on the sheet discharging port 2 side thereof is pivotably mounted on the image forming apparatus 1, and when the image forming apparatus 1 is not used, the discharged-sheet table device 3 is pivoted such as to cause the other end portion to be sprung up, so as to be used also as a cover of the image forming apparatus 1.

In addition, a discharged-sheet table device 30 having a movable structure, such as the one shown in FIGS. 11A–11B is also known. A base 31 is fixed to a body frame 1*a* of the image forming apparatus 1. The discharged-sheet table device 30 is mounted on the base 31 in such a manner as to be movable in a direction perpendicular to the discharging direction of the recording sheet. Namely, a holding member 32 is fixed to one end portion of the discharged-sheet table device 30 which is the body frame 1*a* side, and this holding member 32 is slidably engaged with the base 31 via DELRIN rollers 33. Further, a lower surface of the discharged-sheet table device 30 is connected to the base 31 via a slide rail 34.

As shown in FIG. 12, the discharged-sheet table device 30 receives in a receiving position E the recorded sheets discharged from the sheet discharging port 2, and places the recorded sheets on an upper surface thereof. After the discharging of the sheets, a pulling-out handle 35 is pulled to pull out the discharged-sheet table device 30 to position for taking out the sheaf of the recorded sheets which is and different from the receiving position E, i.e., to a position F for taking out the sheaf of the recorded sheets and located in a position offset from the discharging direction of the recorded sheet, i.e., in a direction perpendicular to the sheet discharging direction in this case.

The conventional discharged-sheet table device presents a relatively small problem if there is leeway in the installation space of the image forming apparatus, but the conventional discharged-sheet table device has the drawback that it is very inconvenient to use if there is little leeway in the installation space. For example, in a case where the image forming apparatus is installed in the vicinity of a wall surface, a corner of a room or the like, the operation of taking out a lot of recording sheets stacked on the discharged-sheet table is effected from the apparatus panel side of the image forming apparatus which is an opposite side to the side which faces the wall surface or the like, and it is difficult and trouble some to perform such an operation.

In addition, particularly in a case where the image forming apparatus 1 is connected to a recording-sheet postprocessing apparatus 4 (mainly, a sorter; hereafter referred to as the sorter) as shown in FIG. 10, it is difficult to take out from the discharged-sheet table the sheaf of the recorded sheets stacked on the discharged-sheet table according to the operation in a nongathering method in which the sorter is not used (hereafter this operation will be referred to as the nonsorting operation). That is, the operation of taking out the sheaf of the recorded sheets in this case must be effected in the gap between the sheet discharging port of the image forming apparatus and the sorter. Moreover, since a sheet conveying device 4*a* comprising a belt conveyor provided for the sorter 4 is disposed on the upper side of the discharged-sheet table, in the case where the sheaf of the recording sheets is taken out from the discharged-sheet table, it is necessary to make use of the narrow space in the gap, so that the discharged-sheet table is very inconvenient to use. Incidentally, the recorded sheet discharged from the discharge port 2 of the image forming apparatus 1 is conveyed to the sorter 4 side by the sheet conveying device 4*a*. Hence, during the aforementioned nonsorting operation, an end portion of the sheet conveying device 4*a* on the discharge port 2 side thereof moves to the position indicated by the dotted lines in FIG. 10, to thereby allow the recording sheet discharged from the discharge port 2 of the image forming apparatus 1 to be discharged onto the discharged-sheet table 3.

In addition, in the case where the discharged-sheet table is movable between the receiving position E for placing the recorded sheet and the taking-out position F for taking out the sheaf of the recoreded sheets as in the case of the discharged-sheet table 30 shown in FIG. 12, the discharged-sheet table 30 must be installed such that the receiving position E is located on the outer side of the image forming apparatus 1 so as not to interfere with the image forming apparatus 1. If such an arrangement is adopted, however, the gap between the discharged-sheet table 30 in the receiving position E and the discharging port 2 becomes longer than the distance which is considered appropriate for receiving the recorded sheets. Hence, there arises the problem that it becomes difficult to properly arrange the sheets of recording sheet which are stacked on the discharged-sheet table 30.

SUMMARY OF THE INVENTION

An object of the present invention is to provide a discharged-sheet table device which excels in its convenience for use, such as in that the discharged-sheet table device makes it possible to take out the sheaf of the recorded sheets easily, even in a case where the device is applied to an image forming apparatus installed in a narrow space or in a case where the device is applied to an image forming apparatus connected to a sorter, and which makes it possible to properly arrange the sheaf of recording sheets which are received.

According to a first aspect of the present invention, there is provided a discharged-sheet table device comprising: a discharged-sheet table mounted at a sheet discharging port of an image forming apparatus and adapted to receive a recorded sheet which is discharged from the sheet discharging port; a first moving mechanism for movably holding the discharged-sheet table between a first position for receiving the recorded sheet discharged from the sheet discharging port and a second position different from the first position; and a second moving mechanism for movably holding the discharged-sheet table between the second position and a third position different from the second position.

According to a second aspect of the present invention, there is provided a discharged-sheet table device comprising: a discharged-sheet table mounted at a sheet discharging port of an image forming apparatus and adapted to receive a recorded sheet which is discharged from the sheet discharging port; a first moving mechanism for movably holding the discharged-sheet table between a first position for receiving the recorded sheet discharged from the sheet discharging port and a second position located forwardly of the first position in a direction in which the recorded sheet is discharged from the sheet discharging port; and a second moving mechanism for movably holding the discharged-sheet table between the second position and a third position located in a position offset from the direction in which the recorded sheet is discharged from the sheet discharging port.

According to a third aspect of the invention, there is provided the discharged-sheet table device of the second aspect, further comprising: fixing means for fixing the first moving mechanism when the discharged-sheet table is between the second position and the third position.

According to a fourth aspect of the invention, there is provided the discharged-sheet table device comprising: a base mounted at a sheet discharging port of an image forming apparatus; a movable base provided movably on the base; and a discharged-sheet table mounted movably on the movable base and adapted to receive a recorded sheet which is discharged from the sheet discharging port. Further, a moving mechanism for a discharged-sheet table is provided between the movable base and the discharged-sheet table. The moving mechanism for a discharged-sheet table movably holds the discharged-sheet table between a first position for receiving the recorded sheet discharged from the sheet discharging port and a second position located forwardly of the first position in a direction in which the recorded sheet is discharged from the sheet discharging port. Further, a moving mechanism for a movable base is disposed between the base and the movable base. The moving mechanism for a movable base guides the movement of the movable base in a predetermined section along a direction perpendicular to the direction in which the recorded sheet is discharged from the sheet discharging port, such that the discharged-sheet table becomes movable between the second position and a third position located in a position offset from the direction in which the recorded sheet is discharged from the sheet discharging port.

According to a fifth aspect of the invention, there is provided the discharged-sheet table device according to the fourth aspect further comprising: fixing means for fixing the first moving mechanism for a discharged-sheet table when the discharged-sheet table is between the second position and the third position.

According to a sixth aspect of the invention, there is provided the discharged-sheet table device further comprising: a shaft provided rotatably on the movable base; a lever for rotating the shaft; a swinging member for coupling together the shaft and the discharged-sheet table so as to move the discharged-sheet table from the first position to the second position in conjunction with the rotation of the shaft; first fixing means provided on the shaft so as to be set in an engaging position when the discharged-sheet table is set in the second position; and second fixing means provided on the movable base so as to engage with the first fixing means set in the engaging position and fix the shaft when the discharged-sheet table is between the second position and the third position.

According to a seventh aspect of the invention, there is provided the discharged-sheet table device according to the sixth aspect, wherein the second fixing means is a lock lever provided rotatably on the movable base, such that the lock lever is set in a position where the lock lever does not engage with the first fixing means when the discharged-sheet table is in the second position, and the lock lever is set in a position where the lock lever engages with the first fixing means after the discharged-sheet table starts to move to the third position away from the second position.

The discharged-sheet table is set in the first position for receiving the recorded sheet which is fed out from the sheet discharging port. The discharged-sheet table can be freely moved to the third position which is offset from the discharging direction of the recorded sheet via the second position which is located at a position forwardly in the discharging direction of the recorded sheet. In a case where the recorded sheet which is stacked on the discharged-sheet table is taken out from the discharged-sheet table, the sheet is taken out after the discharged-sheet table is moved from the first position to the third position via the second position. The recorded sheet stacked on the discharged-sheet table can be easily taken out irrespective of the relative narrowness of the installation space, or irrespective of the presence or absence of a connecting device which is installed on the upward side of the discharged-sheet table in a case where a sorter or the like is connected.

DETAILED DESCRIPTION OF THE PREFERRED EMBODIMENTS

Hereafter, referring to FIGS. 1 through 9, a description will be given of an embodiment of the present invention.

Figure 1:
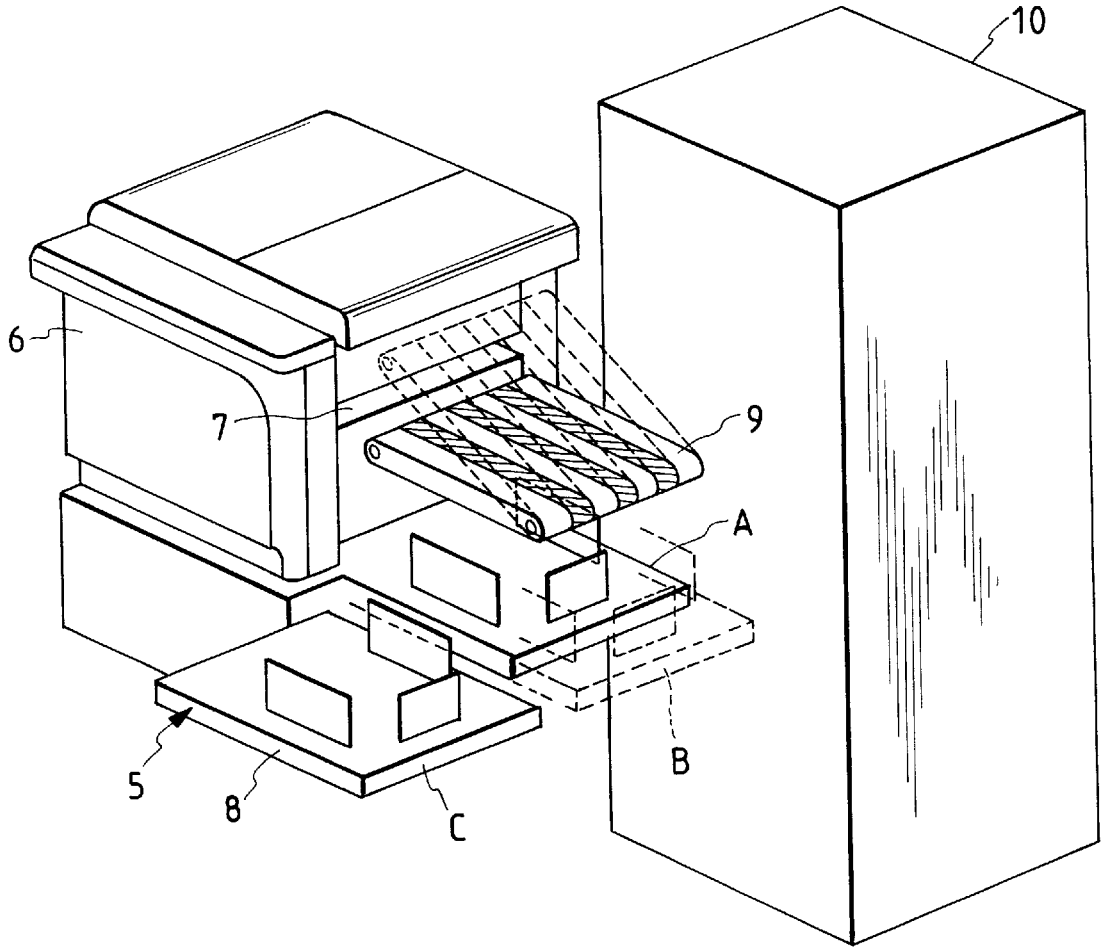
FIG. 1 is a perspective view illustrating an overall arrangement of an image forming apparatus and a discharged-sheet sheet table device according to the present invention.

FIG. 1 is a perspective view illustrating a state in which a discharged-sheet table 5 in accordance with the present invention is applied to an image forming apparatus 6. In the drawing, reference numeral 6 denotes an image forming apparatus, such as a copying machine, a laser beam printer, or a printing machine, all of which are conventionally well-known. A sheet discharging port 7 for discharging recorded sheets which have been recorded is provided at one side surface of the image forming apparatus 6. The discharged-sheet table device 5 having a discharged-sheet table 8 at a position below the sheet discharging port 7 is mounted on the side surface of the image forming apparatus 6.

The discharged-sheet table 8 is movable between a first position A in which the recorded sheets discharged from the sheet discharging port 7 of the image forming apparatus 6 are received and are stacked and a second position B which is located forwardly of the first position A in the discharging direction of the recorded sheets. The discharged-sheet table 8 is also movable between the second position B and a third position C which is offset from the second position B in a direction perpendicular to the discharging direction of the recorded sheets. Incidentally, in the drawing, reference numeral 10 denotes a sorter, and the recorded sheets discharged from the sheet discharging port 7 of the image forming apparatus 6 are conveyed by a sheet conveying device 9 which is constituted by a belt conveyor provided on the sorter 10. During the nonsorting operation, as shown in FIG. 1, an end portion of the sheet conveying device 9 on the discharging port 7 side of the image forming apparatus 6 moves to the position indicated by the dotted lines, to thereby allow the recorded sheets to be discharged onto the discharged-sheet table 8.

By first referring mainly to FIGS. 2 to 4, descriptions will be given of the structure of the discharged-sheet table device 5 in accordance with this embodiment. A fixing and supporting means 12 serving as a base of the discharged-sheet table device 5 is detachably mounted on a body frame 11 of the image forming apparatus 6. The fixing and supporting means 12 is a box-shaped member, and is disposed on an outer side of the body frame 11. A pair of rail connecting members 13 and 14 are fixed to an upper surface of the fixing and supporting means 12. A box-shaped movable base 17 as movably mounted on the pair of rail connecting members 13 and 14 via a pair of slide rails 15 constituting a moving mechanism. The slide rails 15 are arranged along a direction perpendicular to the discharging direction of the recorded sheets (hereafter referred to as the sheet discharging direction) which are discharged from the sheet discharging port 7. Therefore, the movable base 17 is movable within a predetermined range along the direction perpendicular to the sheet discharging direction.

Figure 2:
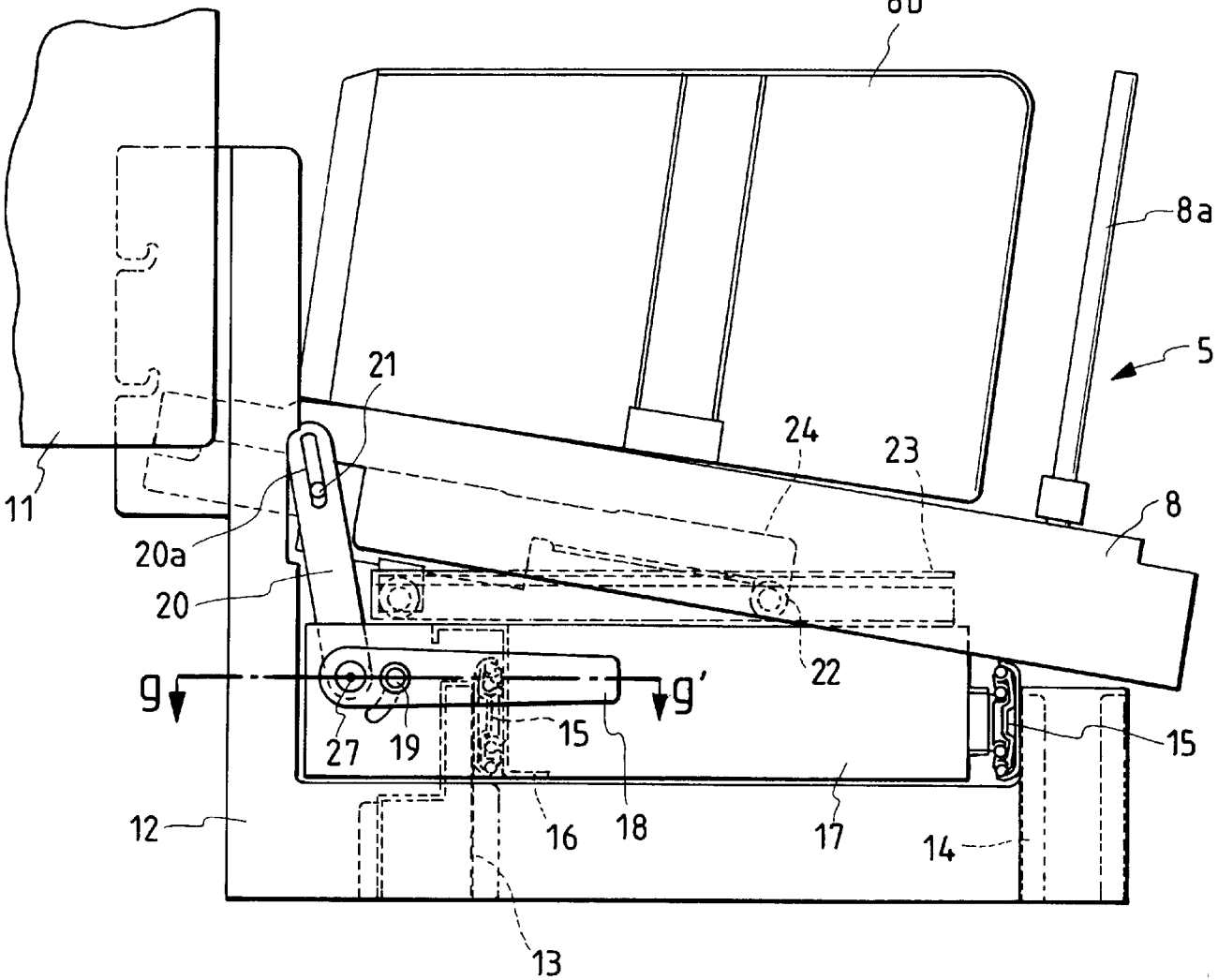
FIG. 2 is a front elevational view of the discharged-sheet table device in accordance with the present invention.
Figure 3:
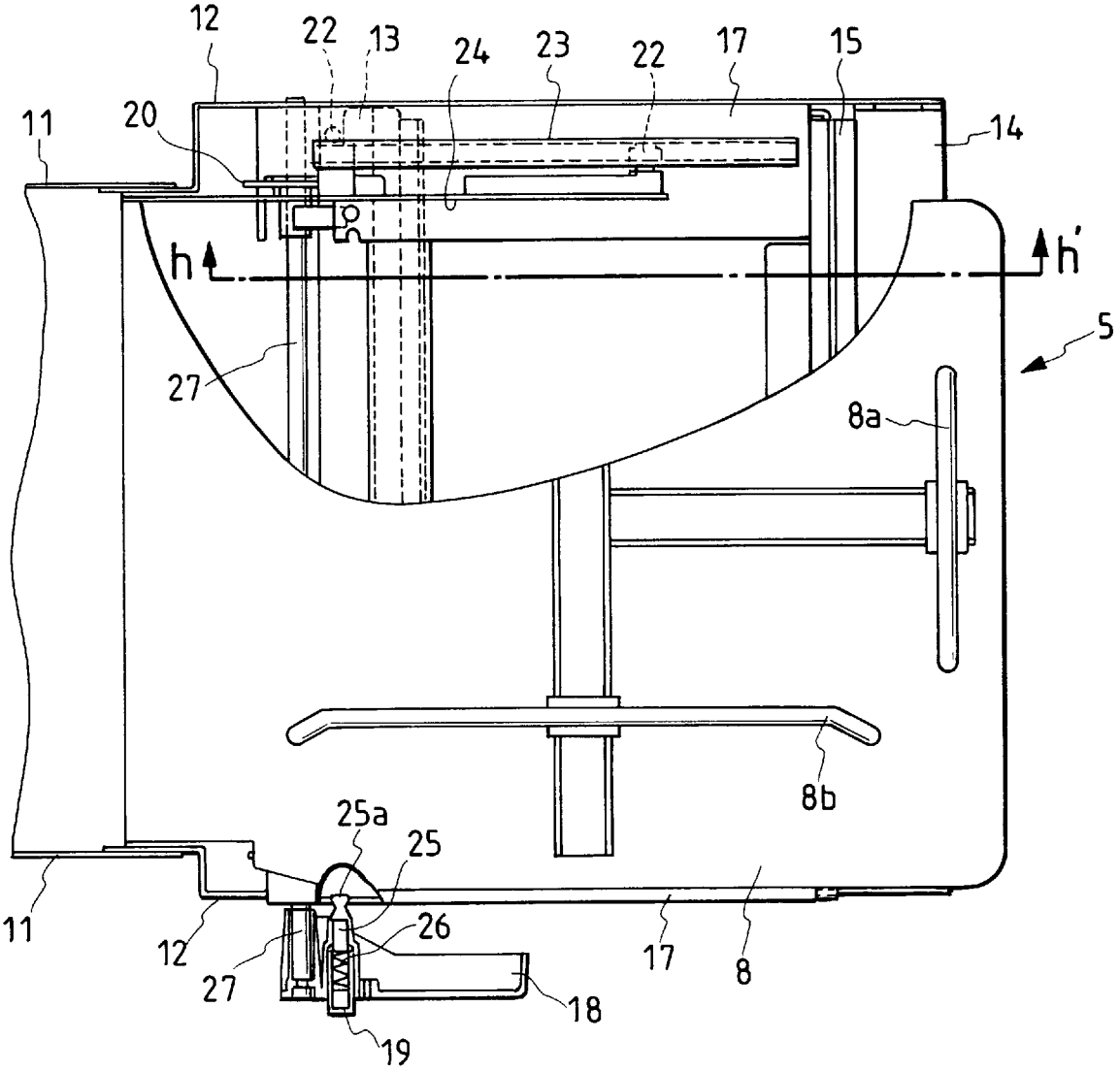
FIG. 3 is a plan view of the discharged-sheet table device in accordance with the present invention.

As shown in FIGS. 2 and 3, the discharged-sheet table device 8 is movably provided on the aforementioned movable base 17. The discharged-sheet table 8 is a plate member having a flat upper surface or a curved surface oriented downwardly in the direction perpendicular to the sheet discharging direction. A pair of side fences 8*b* and an end fence 8*a* are provided uprightly on the upper surface of the discharged-sheet table 8 such that their positions are adjustable.

The discharged-sheet table 8 is disposed on the movable base 17 in such a manner as to be movable by a moving mechanism which will be described below. As shown in FIGS. 2 to 4, a pair of supporting members 24 each having two rollers 22 are respectively fixed to a lower surface of the discharged-sheet table 8 at its two sides extending along the sheet discharging direction. A pair of roller guides 23 are respectively disposed on an upper surface of the movable base 17 at its two sides extending along the sheet discharging direction, in such a manner as to be parallel to the sheet discharging direction. The rollers 22 are movably engaged with each roller guide 23, so that the discharged-sheet table 8 is movable within a predetermined range along the direction parallel to the sheet discharging direction (which will be described later).

As shown in FIGS. 2, 3, 8, and 9, a horizontal shaft 27 perpendicular to the sheet discharging direction is rotatably provided on a side of the movable base 17 which is close to the body frame 11. One end of the shaft 27 projects from a side surface of the movable base 17. A lever 18 for rotating the shaft is fixed to that end of this shaft 27. When an operator rotates the lever 18, the shaft 27 rotates. A lever shaft 25 is provided on a proximal portion of the lever 18 in such a manner as to extend parallel to the shaft 27. The lever shaft 25 is movable within a predetermined range in its axial direction. A lever button 19 is provided on an outer end portion of the lever shaft 25. A stepped portion 25*a* is formed on an inner end portion of the lever shaft 25, and the stepped portion 25*a* is engaged with a circular arc-shaped groove 17*a* which is formed in a side surface of the movable base 17. A spring 26 is fitted over the lever shaft 25 so as to urge the lever shaft 25 in the outward direction, causing the stepped portion 25*a* to be engaged with the groove 17*a*. In a state in which the operator does not touch the lever button 19, the spring 26 urges the lever shaft 25 in the outward direction and causes the stepped portion 25*a* to be retained in the groove 17*a*, so that the lever 18 cannot be operated to rotate. If the operator presses the lever button 19 against the urging force of the spring 26, the stepped portion 25*a* of the lever shaft 25 is disengaged from the groove 17*a*, so that the lever 18 can be rotated in this state.

As shown in FIGS. 2, 4, 8, and 9, the shaft 27 is provided with a pair of swinging members 20 at a predetermined interval therebetween. The swinging members 20 are elongated members each having the shape of a rod plate. The swinging members 20 have their one ends secured to the shaft 27 such that their attaching attitudes with respect to the rotating direction of the shaft 27 become identical. Elongated holes 20*a* are respectively formed in the other end portions of the swinging members. Bosses 21 are respectively attached to outer side surfaces of the aforementioned supporting members 24 at positions close to the body frame 11. The bosses 21 of the supporting members 24 are engaged in the elongated holes 20*a* provided in the distal ends of the swinging members.

If the lever 18 is rotated, the shaft 27 rotates, which in turn causes the swinging members 20 to swing. In conjunction with the swinging motion of the swinging members 20, the discharged-sheet table 8 is moved on the movable base 17 along the sheet discharging direction along the roller guides 23. At this time, a portion of the lever shaft 25 which is offset from the stepped portion 25*a* rotates inside the groove 17*a*, with the result that the rotating angle of the lever 18, i.e., the moving range of the discharged-sheet table 8, is restricted. In the moving range of the discharged-sheet table 8 parallel to the sheet discharging direction, the position in which the discharged-sheet table 8 is closest to the body frame 11 will be referred to as a first position A, and in this position the discharged-sheet table 8 receives the recorded sheets discharged from the image forming apparatus 6. An end portion of the discharged-sheet table 8 on the body frame 11 side, which is in the first position A, is located on the inner sides of portions of the fixing and supporting means 12 and the body frame 11. The position in which the discharged-sheet table 8 is farthest from the body frame 11 in the sheet discharging direction will be referred to as a second position B. After the discharged-sheet table 8 is set in the second position B, if the lever 18 is pulled toward this side (in the direction perpendicular to the sheet discharging direction), the movable base 17 moves in the direction perpendicular to the sheet discharging direction along the slide rails 15. In the moving range of the movable base 17 and the discharged-sheet table 8 which move from the second position B in the direction perpendicular to the sheet discharging direction, the position in which the movable base 17 and the discharged-sheet table 8 are farthest from the second position B will be referred to as a third position C.

Figure 4:
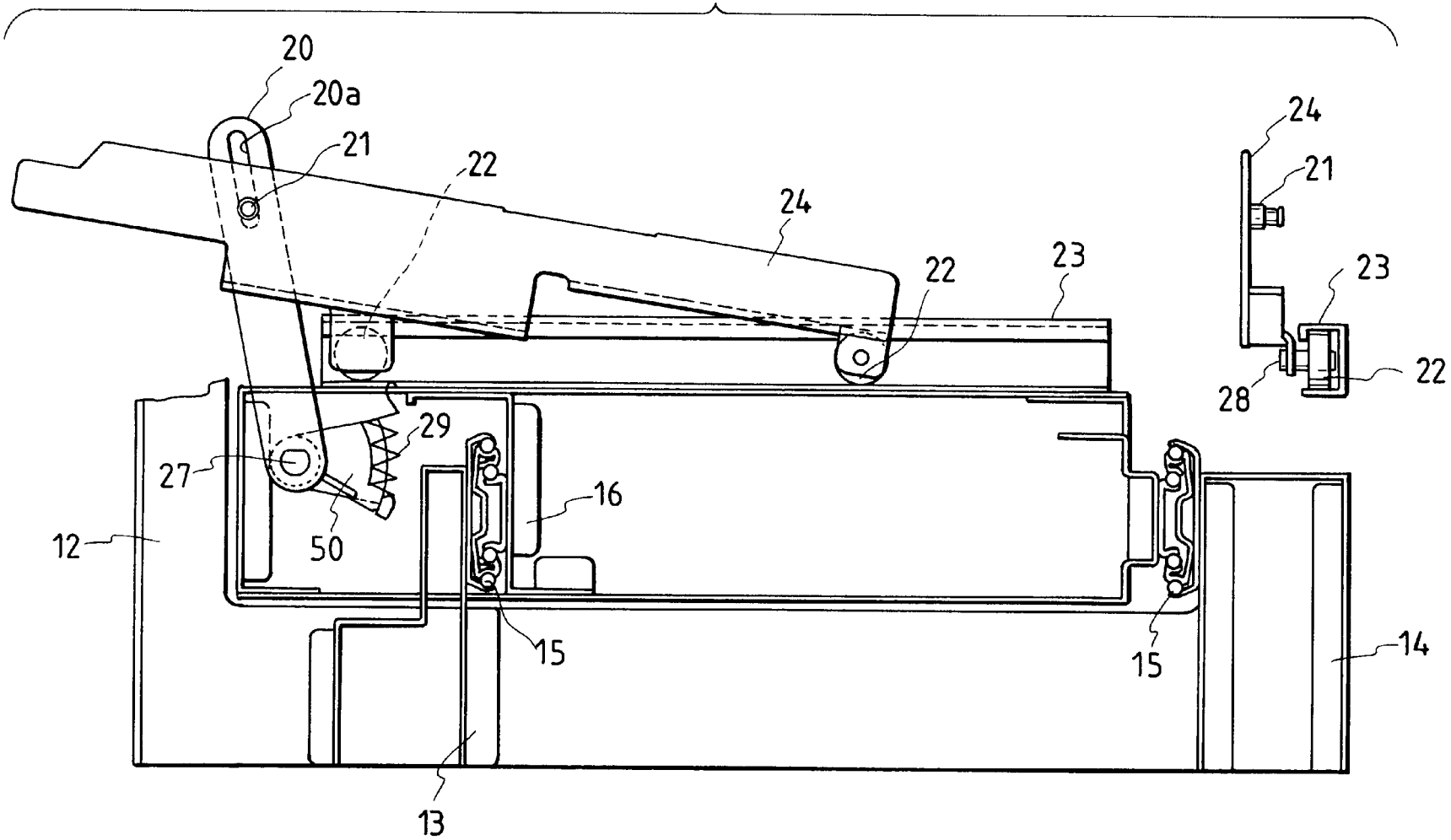
FIG. 4 is a cross-sectional view along a line h–h' in FIG. 2 showing the discharged-sheet table device in accordance with the present invention.
Figure 5A:
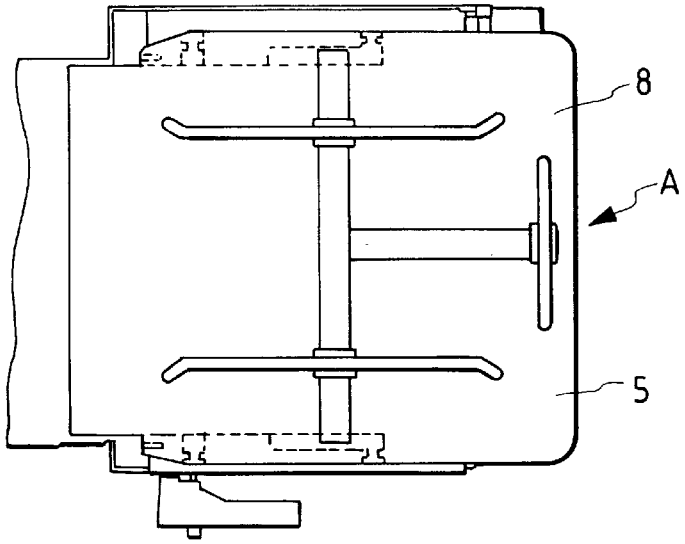
FIGS. 5(*a*) and 5(*b*) are a plan view and a front elevational view of the discharged-sheet table device in accordance with the present invention, and illustrate a state in which a discharged-sheet table is in a first position.
Figure 5B:
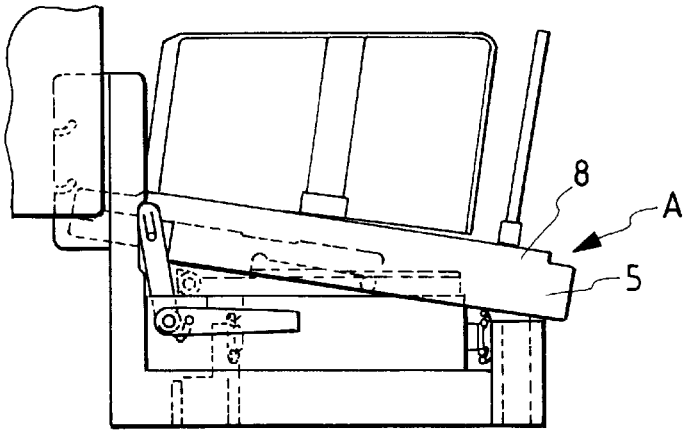
Figure 6:
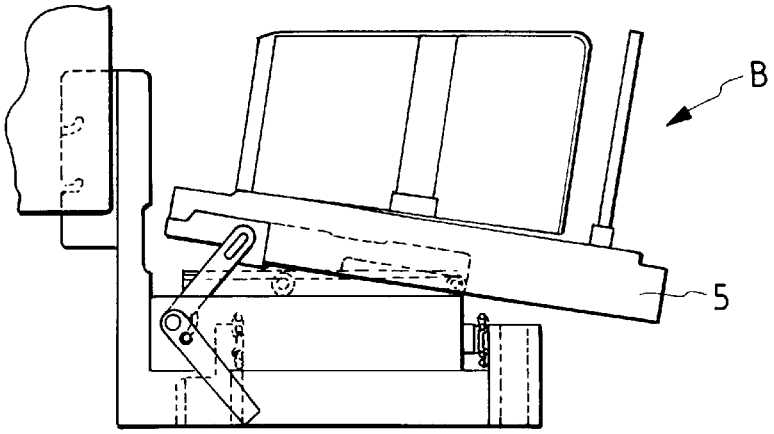
FIG. 6 is a front elevational view of the discharged-sheet table device in accordance with the present invention, and illustrates a state in which the discharged-sheet table is in a second position.
Figure 7:
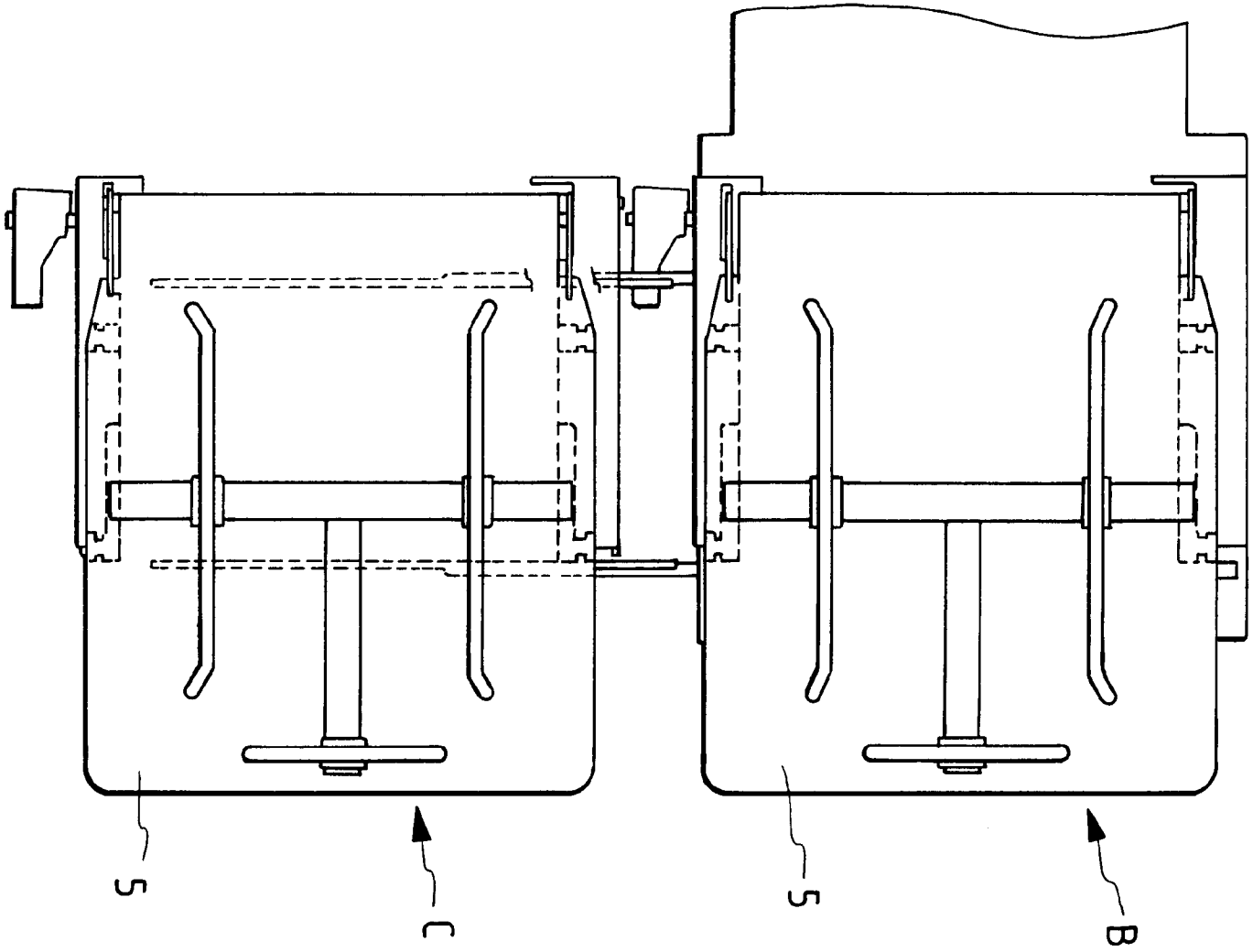
FIG. 7 is a plan view of the discharged-sheet table device in accordance with the present invention, and illustrates both states in which the discharged-sheet table is in the second position and in a third position.
Figure 8:
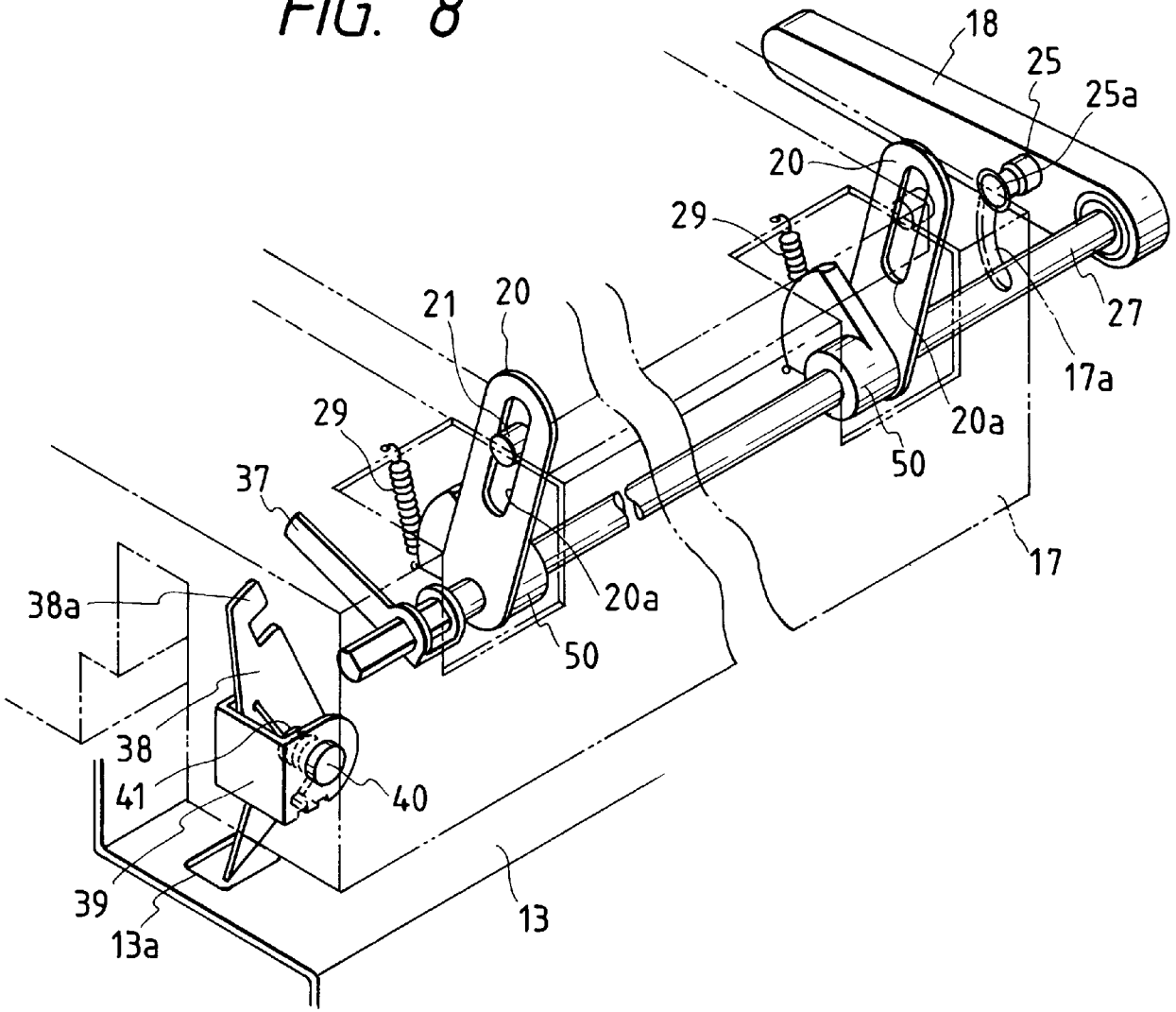
FIG. 8 is a perspective view of an internal mechanism in the vicinity of a movable base in the discharged-sheet table device in accordance with the present invention, as well as its operation.
Figure 9:
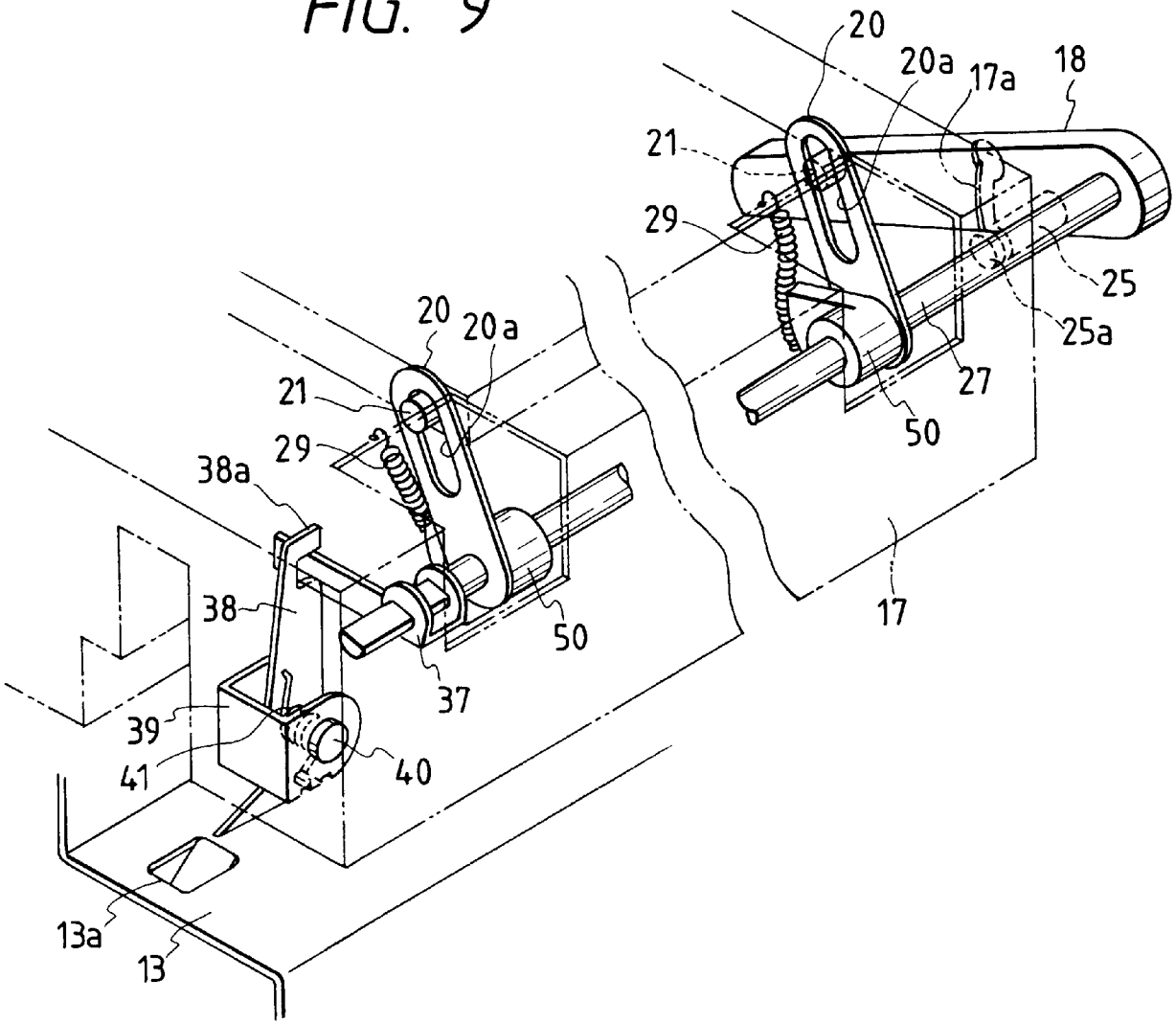
FIG. 9 is a perspective view of the internal mechanism in the vicinity of the movable base in the discharged-sheet table device in accordance with the present invention, as well as its operation.
Figure 10:
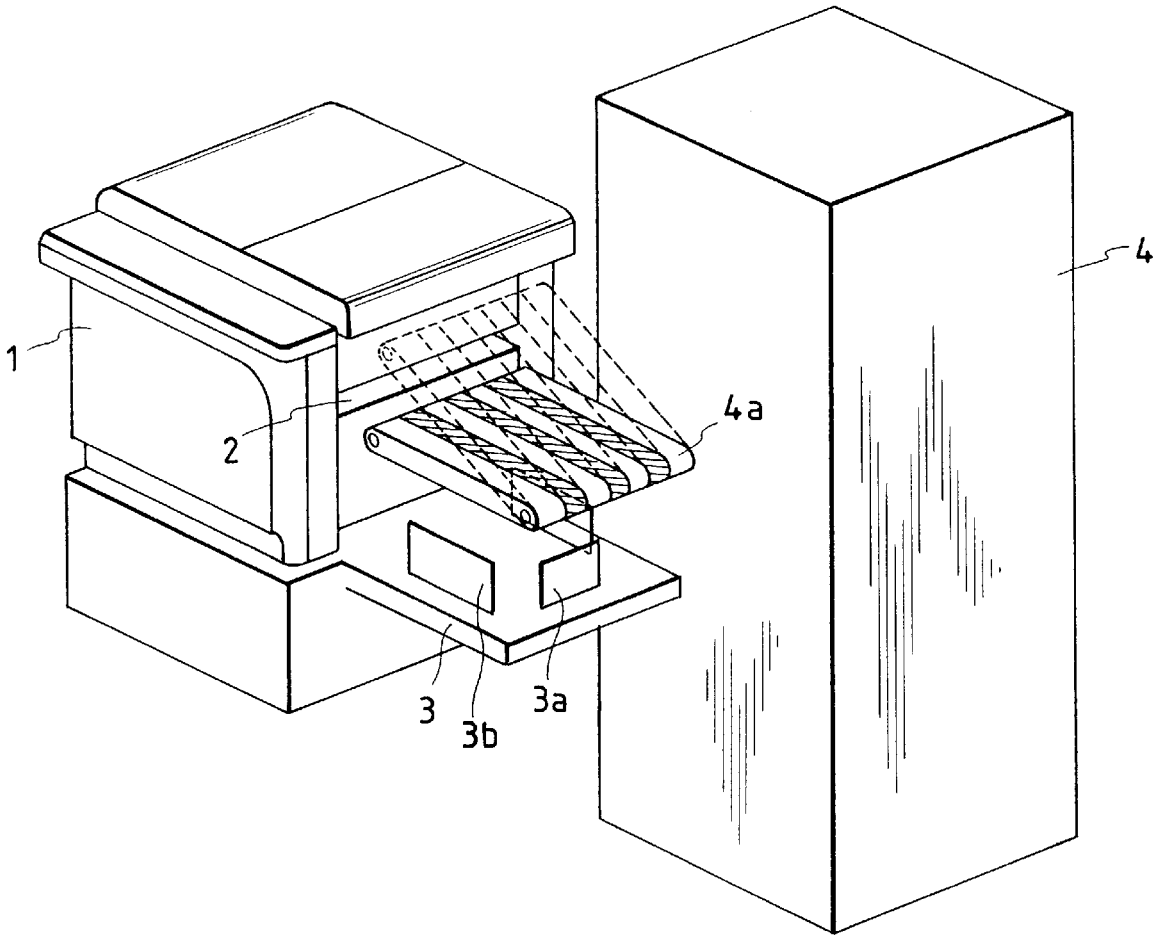
FIG. 10 is a perspective view illustrating a conventional discharged-sheet table device attached to an image forming apparatus.
Figure 11A:
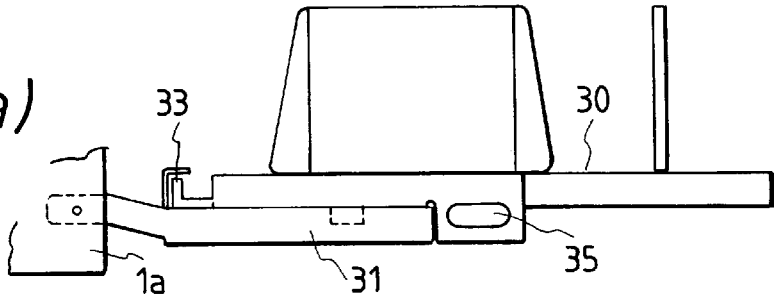
FIGS. 11(*a*) and 11(*b*) show a structure of the conventional discharged-sheet table device, more specifically, FIG. 11(*b*) is a sectional view along a line k–k' in FIG. 12.
Figure 11B:
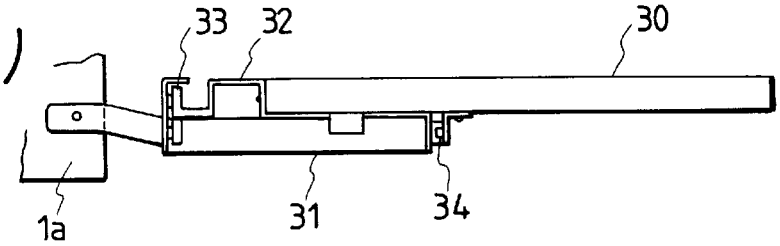
Figure 12:
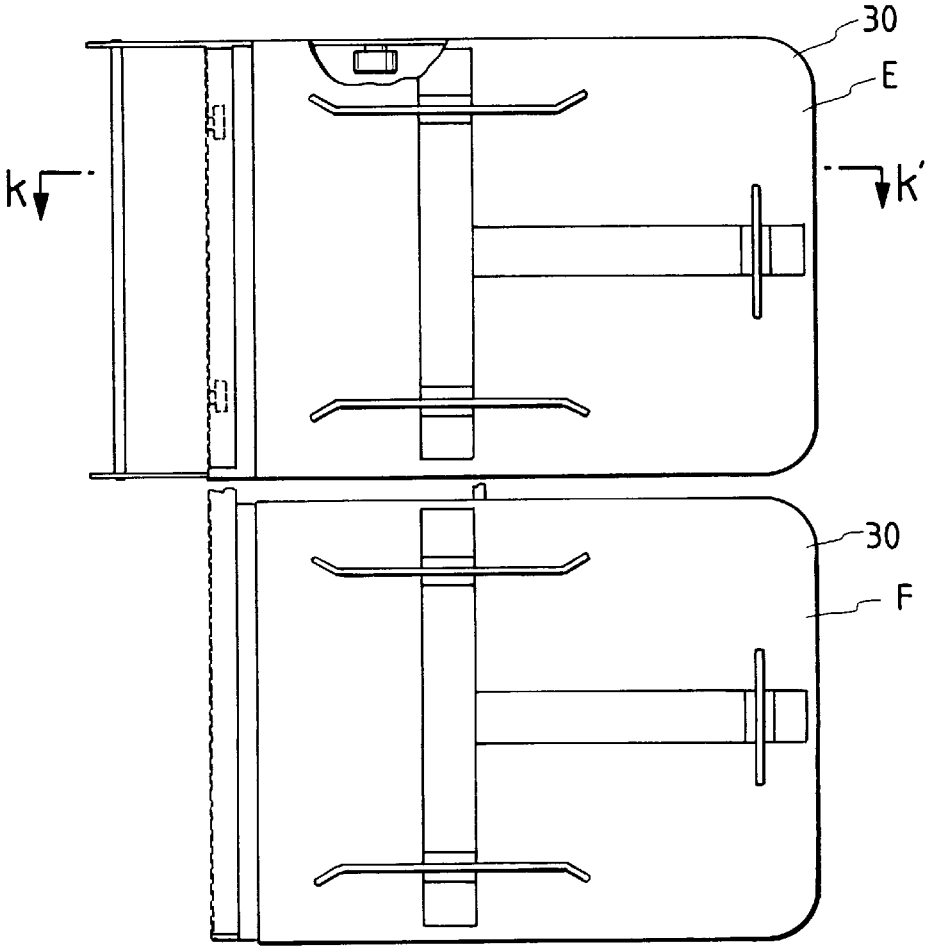
FIG. 12 is a diagram illustrating the operation of the conventional discharged-sheet table device.

As shown in FIGS. 4, 8, and 9, mounting members 50 each having a fan-shaped distal end portion are secured to those portions of the shaft 27 to which the swinging members 20 are fixed. The distal end portions of the mounting members 50 are respectively coupled to the movable base 17 by means of springs 29. By the springs 29, the shaft 27 is urged in a direction in which the discharged-sheet table 8 returns from the second position B toward the first position A.

While the discharged-sheet table 8 moves from the second position B to the third position C, the position of the discharged-sheet table 8 is fixed by fixing means so that the discharged-sheet table 8 does not move on the movable base 17. As shown in FIGS. 8 and 9, one end portion of a lock lever 37 serving as a first fixing means is fixed to one end of the shaft 27. When the shaft 27 is rotated by the lever 18, and the discharged-sheet table 8 is set in the second position B, the lock lever 37 is set in a predetermined engaging position.

As shown in FIGS. 8 and 9, a lock lever 38 serving as a second fixing means is provided on the movable base 17 in the vicinity of the lock lever 37. The lock lever 38 is provided in such a manner as to be rotatable about a supporting shaft 40 via a supporting member 39. A spring 41 is interposed between the supporting member 39 and the lock lever 38, thereby urging a retaining portion 38*a* provided at a distal end portion of the lock lever 38 in a direction away from the lock lever 37. A notched portion 13*a*, into which a rear end portion of the lock lever 38 falls, is formed in the rail connecting member 13 of the fixing and supporting means 12. In a state in which the movable base 17 has not moved with respect to the fixing and supporting means 12, the rear end portion of the lock lever 38 is accommodated in the notched portion 13*a* of the rail connecting member 13 as shown in FIG. 8, and since the lock lever 38 and the lock lever 37 do not engage each other, the shaft 27 can be rotated freely. If the movable base 17 is moved from the second position B to the third position C, as shown in FIG. 9, the lock lever 38 rotates and its rear end portion comes out of the notched portion 13*a*. At that time, the lock lever 37 is set in a retaining position, so that the retaining portion 38*a* of the lock lever 38 which has rotated engages with the lock lever 37 which is in its retaining position. Consequently, during the movement of the movable base 17 from the second position B to the third position C, the shaft 27 cannot rotate, so that the discharged-sheet table 8 is immovable on the movable base 17.

Next, referring to FIGS. 5 to 9, descriptions will be given of the operation of this discharged-sheet table device 5 constructed as described above. After an image is formed by the image forming apparatus 6, the recorded sheets which are discharged from the sheet discharging port 7 are stacked on the discharged-sheet table 8 which is set in the first position A shown in FIG. 5. To remove the sheaf of the recorded sheets stacked on the discharged-sheet table 8, the discharged-sheet table 8 is moved from the first position A shown in FIG. 5 to the second position B shown in FIGS. 6 and 7, and is further moved from the second position B to the third position shown in FIG. 7.

If the lever button 19 is pressed, the stepped portion 25*a* of the lever shaft 25 which is retained in the groove 17*a* of the movable base 17 is disengaged from the groove 17*a*, so that the lever shaft 25 becomes rotatable along the groove 17*a*, thereby making it possible to rotate the lever 18. On the other hand, if the lever button 19 is not pressed, the lever 18 cannot be rotated.

As shown in FIGS. 8 and 9, the lever 18 is rotated to a limit of the operating range. The operation of the lever 18 causes the shaft 27 to rotate, which in turn causes the swinging members 20 to swing, thereby allowing the discharged-sheet table 8 to move from the first position A to the second position B. At the same time, the lock lever 37 fixed to the shaft 27 is also rotated, so that the lock lever 37 is set in such an engaging position in which the lock lever 37 is fitted to the lock lever 38 in an ensuing operation (movement from the second position B to the third position C).

The time required for the discharged-sheet table 8 to move from the first position A to the second position B is short, and a portion of the discharged-sheet table 8 is on the inner sides of a portion of the fixing and supporting means substantially during a half of that time, so that the movable base 17 is prevented from moving along the slide rails. Namely, the moving mechanism of the movable base 17 is restricted as the movable base 17 itself is restricted by the fixing and supporting means 12.

After the discharged-sheet table 8 is set in the second position B, the lever 18 is pulled toward this side (in the direction perpendicular to the sheet discharging direction). As shown in FIG. 9, since the rear end portion of the lock lever 38 comes out of the notched portion 13*a* of the rail connecting member 13, the lock lever 38 rotates toward the lock lever 37 with the supporting shaft 40 as its fulcrum, and the retaining portion 38*a* at its distal end portion is fitted to the lock lever 37 which is in the retaining position.

At this time, the shaft 27 becomes unrotatable by means of the lock lever 37. That is, when the discharged-sheet table 8 is moving between the second position B and the third position C, the lock lever 37 and the lock lever 38 are fitted to each other. Hence, the position of the movable base 17 is fixed with respect to the fixing and supporting means 12, and the discharged-sheet table 8 is held in such a manner as not to move toward the first position A.

Thus, the discharged-sheet table 8 moves from the first position A to the second position B along the sheet discharging direction, and further moves from the second position B to the third position C along the direction perpendicular to the sheet discharging direction. During the movement from the second position B to the third position C, the discharged-sheet table 8 is prevented from moving along the sheet discharging direction. Since the discharged-sheet table 8 is set in the third position C which is an offset position located outwardly of the sheet discharging port 7 of the image forming apparatus 6, the stacked recorded sheets can be taken out easily.

Next, the discharged-sheet table 8 is returned again to the first position A. As the lever 18 is pressed toward the innermost side along the direction perpendicular to the sheet discharging direction, the discharged-sheet table 8 is moved from the third position C to the second position B. As shown in FIG. 8, when the discharged-sheet table 8 and the movable base 17 have arrived at the second position B, the rear end portion of the lock lever 38 falls into the notched portion 13*a* in the rail connecting member 13. Consequently, the lock lever 38 rotates with the supporting shaft 40 as a fulcrum by being urged by the spring 41, so that the retaining portion 38*a* at the distal end portion which has been fitted to the lock lever 37 is disengaged from the lock lever 37. As a result, the shaft 27 becomes rotatable, so that the discharged-sheet table 8 can be moved from the second position B to the first position A.

At this time, since the shaft 27 is urged by the springs 29 in such a manner as to aid the rotation in the predetermined direction, the discharged-sheet table 8 can be moved smoothly from the second position B to the first position A.

In the discharged-sheet table device in accordance with the present invention, the discharged-sheet table can be moved from the first position which is close to the sheet discharging port and in which the recorded sheets discharged from the sheets discharging port can be received with proper arrangement of the sheet, to the second position remote from the sheet discharging port along the sheet discharging direction, and the discharged-sheet table can be further moved from the second position to the third position which is moved in the direction perpendicular to the sheet discharging direction. When the recorded sheets are discharged from the image forming apparatus, the recorded sheets can be received by setting the discharged-sheet table in the first position, and can be stacked with proper arrangement of the sheets. After completion of the discharge, the discharged-sheet table can be moved to the third position remote from the image forming apparatus, and the operation of taking out the sheaf of the recorded sheets can be effected easily.

Namely, in accordance with the present invention, the stacked recorded sheets can be easily taken out from the discharged-sheet table irrespective of the relative narrowness of the installation space or the presence or absence of a wall in the vicinity of an installation site, or irrespective of the presence or absence of a connecting device which is installed on the upward side of the discharged-sheet table in a case where a sorter or the like is connected.

In addition, in accordance with the discharged-sheet table device of the present invention, since the position where the discharged-sheet table receives and stacks the sheaf of the recorded sheets is the same as the position where the conventional fixed-type discharged-sheet table receives the recorded sheets, it is possible to properly arrange and stack the recorded sheets without disrupting the uniformity in arrangement.

What is claimed is:

1. A discharged-sheet table device for receiving a recorded sheet discharged from a sheet discharging port of an image forming apparatus, said discharged-sheet table device comprising:

a discharged-sheet table mounted at the sheet discharging port of the image forming apparatus, for receiving the recorded sheet being discharged from the sheet discharging port, said discharged-sheet table having a mounting mechanism for mounting said discharged-sheet table to the image forming apparatus;

a first moving mechanism for movably holding said discharged-sheet table between a first position for receiving the recorded sheet discharged from the sheet discharging port and a second position different from the first position; and a second moving mechanism for movably holding said discharged-sheet table between the second position and located in a position offset horizontally from a direction in which the recorded sheet is discharged from the sheet discharging port and a third position different from the second position.

2. A discharged-sheet table device for receiving a recorded sheet discharged from a sheet discharging port of an image forming apparatus, said discharged-sheet table device comprising:

a discharged-sheet table mounted at the sheet discharging port of the image forming apparatus, for receiving the recorded sheet being discharged from the sheet discharging port;

a first moving mechanism for movably holding said discharged-sheet table between a first position for receiving the recorded sheet discharged from the sheet discharging port and a second position located forwardly of the first position in a direction in which the recorded sheet is discharged from the sheet discharging port; and a second moving mechanism for movably holding said discharged-sheet table between the second position and a third position located in a position offset horizontally from the direction in which the recorded sheet is discharged from the sheet discharging port.

3. The discharged-sheet table device according to claim 2, further comprising:

fixing means for fixing said first moving mechanism at a position where said discharged-sheet table is between the second position and the third position.

4. The discharged-sheet table device according to claim 2, wherein said discharged-sheet table has a mounting mechanism for mounting said discharged-sheet table to the image forming apparatus.

5. A discharged-sheet table device for receiving a recorded sheet discharged from a sheet discharging port of an image forming apparatus, said discharged-sheet table device comprising:

a first base mounted at the sheet discharging port of the image forming apparatus;

a second base movably supported on said first base;

a discharged-sheet table movably mounted on said second base, for receiving the recorded sheet which is discharged from the sheet discharging port;

a table moving mechanism provided between said second base and the discharged-sheet table, for movably holding said discharged-sheet table between a first position where the recorded sheet discharged from the sheet discharging port is received and a second position located forwardly of the first position in a direction in which the recorded sheet is discharged from the sheet discharging port; and a first base moving mechanism disposed between said first base and said second base, for movably holding said second base in a predetermined section along a direction perpendicular to the direction in which the recorded sheet is discharged from the sheet discharging port, such that said discharged-sheet table becomes movable between the second position and a third position located in a position offset horizontally from the direction in which the recorded sheet is discharged from the sheet discharging port.

6. The discharged-sheet table device according to claim 5, further comprising:

fixing means for fixing said table moving mechanism at a position where the discharged-sheet table is between the second position and the third position.

7. The discharged-sheet table device according to claim 6, further comprising:

a shaft rotatably provided on said second base;

a lever for rotating said shaft;

a swinging member for coupling together said shaft and said discharged-sheet table so as to move said discharged-sheet table from the first position to the second position in conjunction with a rotation of said shaft;

first fixing means provided on said shaft so as to be set in an engaging position when said discharged-sheet table is set in the second position; and second fixing means provided on said second base so as to engage with said first fixing means set in the engaging position and fix the shaft when said discharged-sheet table is between the second position and the third position.

8. The discharged-sheet table device according to claim 7, wherein said second fixing means includes a lock lever provided rotatably on said second base, such that said lock lever is set in a position where said lock lever does not engage with said first fixing means when said discharged-sheet table is in the second position, and said lock lever is set in a position where the lock lever engages with the first fixing means after said discharged-sheet table starts to move to the third position away from the second position.

9. The discharged-sheet table device according to claim 5, wherein said first base has a mounting mechanism for mounting said first base to the image forming apparatus.

* * * * *